US006125939A

United States Patent [19]

Abreo, Jr.

[11] Patent Number: 6,125,939

[45] Date of Patent: Oct. 3, 2000

[54] REMOTELY DEPLOYABLE LANDING SHOULDER

[75] Inventor: William A. Abreo, Jr., Houston, Tex.

[73] Assignee: Cooper Cameron Corporation, Houston, Tex.

[21] Appl. No.: 09/115,823

[22] Filed: Jul. 15, 1998

[51] Int. Cl.[7] ..... E21B 43/10

[52] U.S. Cl. ..... 166/348; 166/368; 166/208

[58] Field of Search ..... 166/348, 368, 166/382, 383, 75.14, 208, 212

[56] References Cited

U.S. PATENT DOCUMENTS

| | | | |
|---|---|---|---|
| 3,592,489 | 7/1971 | Baugh et al. . | |
| 4,067,388 | 1/1978 | Mouret et al. . | |
| 4,139,059 | 2/1979 | Carmichael . | |
| 4,917,191 | 4/1990 | Hopmann et al. . | |
| 4,982,795 | 1/1991 | King . | |
| 5,066,048 | 11/1991 | Farrell . | |
| 5,638,903 | 6/1997 | Kent | 166/208 |
| 5,655,606 | 8/1997 | Ferguson . | |
| 5,839,512 | 11/1998 | Malone et al. | 166/348 |

FOREIGN PATENT DOCUMENTS 98302854 4/1998 European Pat. Off. .

*Primary Examiner*—William Neuder

*Attorney, Agent, or Firm*—Duane, Morris & Heckscher LLP

[57] ABSTRACT

A landing shoulder is provided on a series of collets extending from a frangible ring. The collets are biased into a groove which is itself in a recess in the wellhead housing. Deployment of the landing shoulder in its retracted position allows an additional string of casing to be run which is nominally close to the inside seal bore diameter of the wellhead housing. The ability to add an additional casing string on a wellhead housing of a particular size allows isolation of water-producing zones near the surface in a cost-effective manner where mud used to control water production is recovered. In a subsequent trip after the large casing is hung below the body, a setting tool engages the rings supporting the collets defining the landing shoulder. The hydraulic pressure built up in the setting tool actuates a piston to break a portion of the ring supporting the collets so that they are driven and locked down in a set position where they define a landing shoulder in the bore for a subsequent run of casing. The actuation is done in the manner to give surface personnel a signal that the collets have been actuated into position to accept the next casing string.

31 Claims, 4 Drawing Sheets

REMOTELY DEPLOYABLE LANDING SHOULDER

FIELD OF THE INVENTION

The field of this invention relates to surface and downhole equipment employing landing shoulders for support of other equipment and more particularly subsea wellheads, where the landing shoulder can be remotely actuated to be set into position in a bore after larger casing has been run.

BACKGROUND OF THE INVENTION

In oil and gas well operations, particularly in subsea applications, wellheads are used to support concentric casing strings which extend to varying depths in the wellbore. Landing shoulders are provided in such wellheads for support of one or more of these strings. These wellheads have seal bores and the landing shoulders provided in them generally define the maximum internal clearance so as to limit the maximum size of casing which can fit through the wellhead. That is to say, the seal bore has a greater diameter than the bore defined by the landing shoulder. The projecting landing shoulder limits the largest casing size that can be run through the wellhead. If it was not in the way, another larger casing string could fit through the same wellhead body. This is the objective of the invention, i.e., to get the landing shoulder out of the way so that a larger additional string can be run and later actuate the landing shoulder into the bore to get a support for the subsequent smaller casing strings.

The need to fit in an extra-large string into an existing wellhead configuration has arisen from subsea completions where substantial amounts of water are produced at very shallow depths into the wellbore. Previous techniques that have been available to deal with the infiltration of water into the wellbore at shallow depths have had undesirable costs associated with them. Since the water migration into the wellbore is at a fairly low depth, control with mud becomes costly since the mud is lost during the casing-running operation through the zones where water is infiltrating. Attempts to cement across the zone where water is infiltrating also involve significant costs with the amount of cement that is required to effectively accomplish the procedure. Thus, the need has arisen for a more effective technique to isolate the zone where water is infiltrating by running an additional string through an existing wellhead. For example, weighted mud can be used and recovered if 18" casing can be run through an 18¾" high-pressure housing. The problem has been that the minimum clearance in 18¾" housings is presently too small to accept 18" casing. Thus, one of the objectives of the present invention is to provide a wellhead housing with a remotely actuable landing shoulder which is mounted in a recess sufficient to allow very-close-clearance casing to be run through a high-pressure housing of a wellhead. At the same time, after the large casing is installed, it is another objective of the invention to be able to remotely actuate a landing shoulder to accept a smaller size casing which is run through the larger casing. It is desirable to actuate the landing shoulder remotely in a manner that gives a signal at the surface that the actuation has occurred and that the landing shoulder is in place. It is another objective of the present invention to configure the remotely actuable landing shoulder so that it cannot be accidentally actuated while the larger size casing is being run through the wellhead housing.

Designs in the past have employed either fixed landing shoulders in wellhead housings or shoulders that can be run-in with a casing string. These devices have generally had to catch recesses in the wellhead housing. The devices were generally held in place with shear pins and were prone to premature set. Operators at the surface did not have good feedback as to whether the string had set on the landing shoulder properly, and many times shoulders run-in with the string to catch a groove in the wellhead body would fail to actuate or fail to actuate in the proper location, undermining the desired intent of support of the string. A few prior designs are illustrated in U.S. Pat. Nos. 4,067,388; 4,917,191; 5,655,606. Also of general interest in the area of multi-string casing supports in wellheads is the STC-10 wellhead made by Cooper Cameron.

SUMMARY OF THE INVENTION

A landing shoulder is provided on a series of collets extending from a frangible ring. The collets are biased into a groove which is itself in a recess in the wellhead housing. Deployment of the landing shoulder in its retracted position allows an additional string of casing to be run which is nominally close to the inside seal bore diameter of the wellhead housing. The ability to add an additional casing string on a wellhead housing of a particular size allows isolation of water-producing zones near the surface in a cost-effective manner where mud used to control water production is recovered. In a subsequent trip after the large casing is hung below the body, a setting tool engages the rings supporting the collets defining the landing shoulder. The hydraulic pressure built up in the setting tool actuates a piston to break a portion of the ring supporting the collets so that they are driven and locked down in a set position where they define a landing shoulder in the bore for a subsequent run of casing. The actuation is done in the manner to give surface personnel a signal that the collets have been actuated into position to accept the next casing string.

DETAILED DESCRIPTION OF THE PREFERRED EMBODIMENT

Figure 2A:
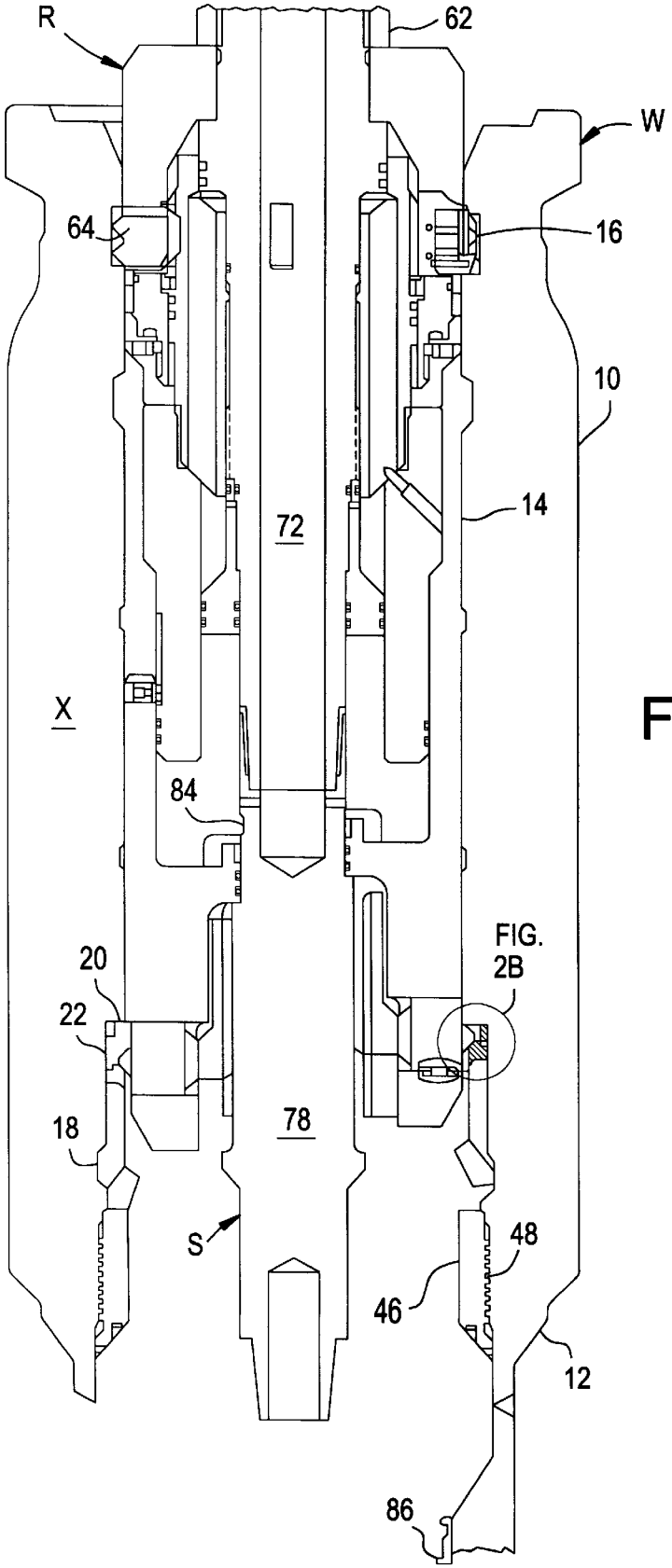
FIG. 2 is a split sectional elevational view of the running and setting tool inside the wellhead housing, showing the setting tool deployed and about to break the ring supporting the landing shoulder on one side of the drawing, and the ring in the broken position with the landing shoulder fully deployed and locked in position in the other part of the drawing.
Figure 2B:
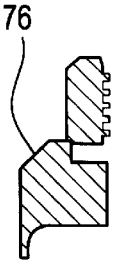
Figure 3:
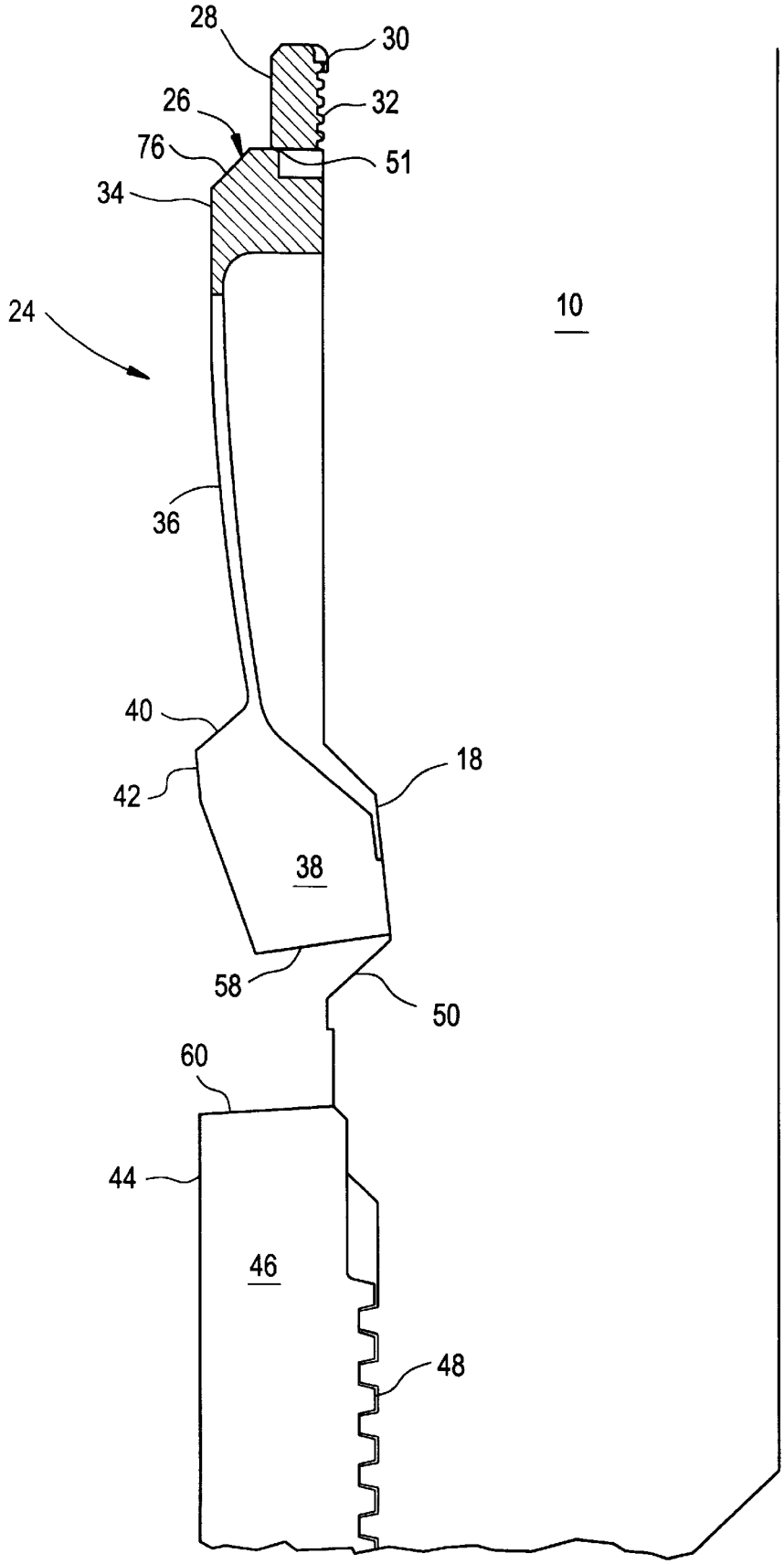
FIG. 3 shows, in a right-hand section, a detailed view of the landing shoulder in the retracted position.

Referring to FIG. 2, the wellhead W has a housing 10 which is generally supported off an outermost casing string (not shown) at shoulder 12. The high-pressure housing 10 has an internal seal bore 14 and a series of internal grooves which will be explained below. An upper groove 16 and a lower groove 18 are the internal grooves of interest for the present invention and will be described in more detail below. Shoulder 20 defines recess 22 which is larger than bore 14. As shown in FIG. 3, the landing shoulder assembly 24 comprises a ring structure 26 which preferably is in one piece, which in operation is broken into several pieces. Ring structure 26 has an upper ring 28 which has threads 30 which are engaged to matching threads 32 in the high-pressure housing 10. The landing shoulder assembly 24 has a lower ring structure 34 from which extend a plurality of fingers 36. Fingers 36 terminate in heads 38. Heads 38 have a landing surface 40 to accept a subsequent casing string when deployed into the position shown in FIG. 4. Collectively, all the surfaces 40 form the landing shoulder. Fingers 36 are manufactured with an inherent bias toward the high-pressure housing 10 shown in FIG. 3. Due to this built-in bias upon manufacturing, the heads 38 remain in groove 18. It should be noted that surface 42 in the position shown in FIG. 3 defines a larger diameter than surface 44 of stop ring 46, thus putting it clear of bore 14. The bore defined by surface 44 is equivalent to bore 14 in high-pressure housing 10. Stop ring 46 is secured to the high-pressure housing 10 by virtue of thread 48.

Figure 4:
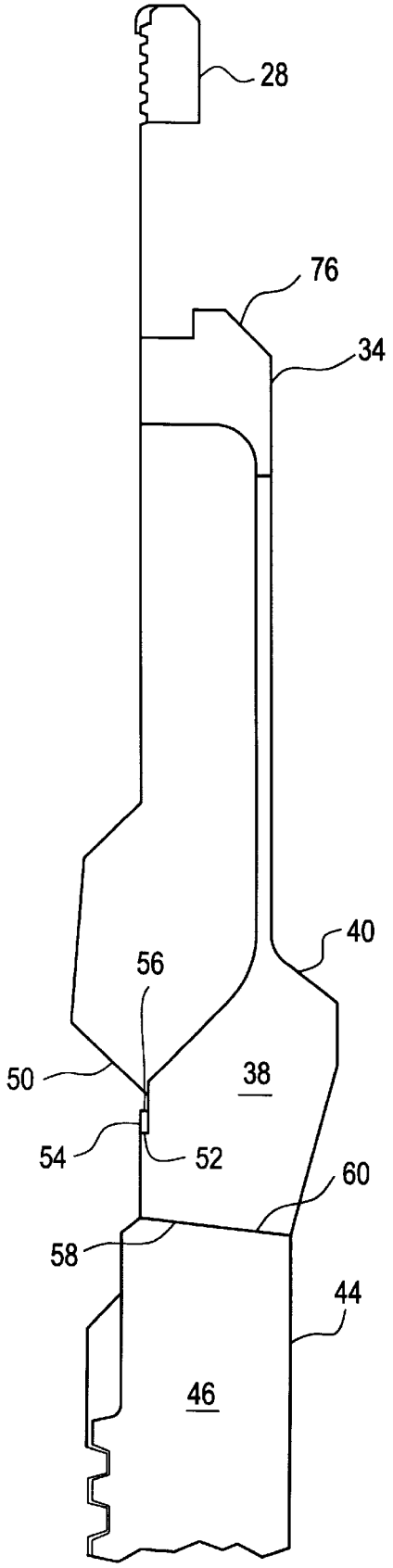
FIG. 4 is a left-hand section of the view in FIG. 3 in the set position.

Referring again to the upper ring 28 and lower ring 34, there exists a junction 51 which represents the connection point between the two rings. The two rings can be an integral design or they can be secured to each other in other ways so that they can be separated with more force required than if shear pins alone were used to hold them together. Rings 28 and 34 need not be contiguous at junction 51 as an intermittent connection can also be used. This junction can be designed to break at a predetermined force. When a force is applied through the use of the running tool R shown in FIG. 1, which has below it setting tool S, the lower ring 34 breaks away from the upper ring 28, as shown in FIG. 4. The heads 38 are pushed along tapered surface 50. Each of the heads 38 has a shoulder 52 which extends into recess 54 of the high-pressure housing 10. Recess 54 defines a reverse shoulder 56 which opposes shoulder 52. Thus, in the position shown in FIG. 4, lower surface 58 reaches its travel stop when it encounters upper surface 60 of the stop ring 46. At the same time, the heads 38 are trapped because of their outward bias which pushes shoulder 52 behind reverse shoulder 56, thus locking in position the heads 38. At this time, the landing surfaces 40 extend beyond surface 44 and are now in position to accept a casing string in a subsequent run.

Figure 1:
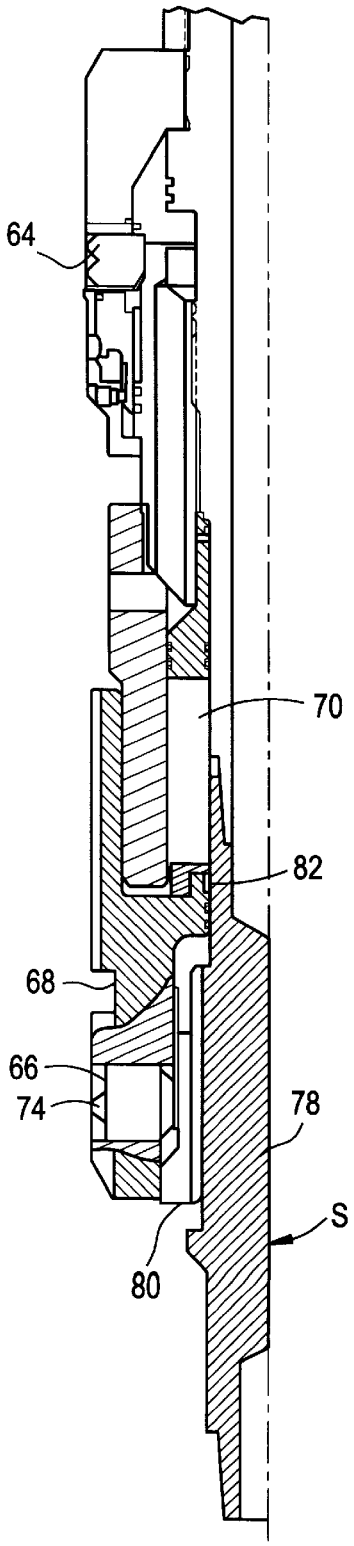
FIG. 1 is a sectional elevational view of the running and setting tool in the run-in position.

The design as previously described is actuated with a running tool R supported by a string 62 which is shown schematically (see FIGS. 1 and 2). The running tool R with the setting tool S are shown in more detail in the run-in position in FIG. 1. Running tool R has actuable dogs 64 adjacent its upper end. When actuated outwardly, as shown in FIG. 2, the dogs 64 engage groove 16. The setting tool S has lower dogs 66 which are carried by piston 68. Piston 68 defines a pressure chamber 70, which is in communication with interior flowpath 72. Flowpath 72 can be pressurized through the string 62 for actuation of the piston 68. Dogs 66 have a projection 74 which is designed to engage surface 76 on lower ring 34. This surface is shown in the detailed view appended to FIG. 2.

The mandrel 78 of the setting tool S supports a cam 80 which ultimately is raised with respect to the mandrel 78 due to rotation of string 62 from the surface to force the dogs 66 outwardly to bring the projection 74 adjacent to surface 76. Through a series of rotational manipulations, the dogs 64 are actuated into groove 16 after the running tool R finds temporary support within the high-pressure housing 10. The same motion that pushes the dogs 64 outwardly brings up cam 80 to push out dogs 66. A detent ring 82 holds the piston 68 to the mandrel 78 until sufficient pressure is built up in chamber 70 to force the detent 82 out of its groove 84. The buildup of pressure in chamber 70 moves the piston 68 and forces the projection 74 against surface 76, ultimately breaking the junction 51.

Surface personnel must increase the pressure in flowpath 72 to a point to drive the detent ring 82 out of groove 84 and to break the junction 51 between lower ring 34 and upper ring 28. When the ring 82 jumps out of groove 84 and the junction 51 is broken, movement of the piston 68 results in a pressure drop at the surface that is noticeable, giving a real-time indication that the setting sequence has been initiated. When the heads 38 reach their maximum travel stop by engaging surface 60, the pressure at the surface will build up, indicating that the set is complete. The applied pressure is then bled off, and the running tool R and setting tool S are further manipulated by rotation to release the dogs 66 and 64 so that the running tool R and setting tool S can be retrieved.

One of the advantages of the present invention should be immediately apparent. In a specific example of an 18¾" high-pressure housing for the wellhead 10, the prior designs had a maximum internal bore of approximately 17.8" which would not accommodate 18" casing. With the configuration as shown in FIG. 2, an 18¾" housing 10 can have an internal bore of 18.63" which can accept 18" casing, which has an outside diameter only slightly smaller. Thus, using the remotely actuable landing shoulder assembly 24, the particular high-pressure housing 10 can accommodate an initial and additional casing size larger than prior designs. This ability to run another casing section through the housing 10 facilitates isolation of shallow water-producing zones in that it permits them to be isolated with drilling mud without significant mud losses as the additional casing section is used and cemented above the water-producing zone prior to drilling through it. In the specific embodiment shown in FIG. 2, for an 18¾" housing 10, the 18" casing is hung at the lower end of the drawing at 86 or below the body 10. Another string, such as 16", can be hung on the 18" casing off of point 86. Subsequently, after the landing shoulder assembly 24 is actuated hydraulically with the setting tool S, smaller casing strings can be run internally to the 13⅝" string. Those skilled in the art will appreciate that there may be intermediate strings between the 18" casing and a smaller string which will ultimately be suspended off of the landing shoulder assembly 24. The string that may be suspended from surface 40 could be 13⅜" casing, for example.

The described design for the remote-actuated landing shoulder above represents an improvement over other designs which incorporate shear screws. Shear screws have limited resistance capabilities. Thus, when actuable using a particular casing string, they are subject to being set prematurely. Additionally, since low forces are required to shear shear pins and the weight of the casing string being run is so large, there was not in the prior designs a good mechanism for feedback to the surface that the string in question had successfully landed on its desired landing shoulder. Additionally, various collet mechanisms or other mechanisms, actuable by breaking shear pins which were delivered by the string being run, were subject to premature actuation if the assembly bound during any portion of the run-in.

The present invention illustrates the ability to get additional utility from a pre-existing wellhead of a given size by allowing yet another casing string to be run through it without sacrificing the pressure rating of the wellhead assembly. The ability to put a remotely actuated landing shoulder in a recess facilitates the additional room for another string to handle a specific downhole problem, such as the need to economically isolate a zone where water is infiltrating the wellbore. Additionally, the system cannot actuate prematurely as it is located within a recess in the housing 10. Thus, the running of the largest-sized casing with the lowest clearance will not engage any part of the heads 38 because they are protected by stop ring 46, as well as being in the recess 22. Eventually, the landing shoulder assembly 24 is actuated into position hydraulically and in a manner which gives positive feedback to surface personnel to tell them that the landing shoulder, represented by surfaces 40 on heads 38, is now in position. In all other respects, the wellhead W operates in a manner known in the art to accommodate a plurality of concentric casing strings.

Although the technique of a landing shoulder which is recessed and remotely actuated has been presented in the context of a wellhead W, other applications downhole are also within the purview of the invention. Thus, in a particular assembly, the system can be deployed to allow a maximum bore diameter for certain downhole operations, coupled with remote actuation to subsequently suspend a particular downhole tool at a predetermined location. In the specific installation depicted in FIG. 2, the ability to have a landing shoulder assembly 24 in a recessed location allows 18" and 16" strings to be hung at point 86. Thereafter, through the use of the running tool R and the setting tool S, the surfaces 40 can be locked into position, as shown in FIG. 4. Thereafter, in the traditional manner, the 13⅝" and smaller strings can all be supported from surface 40.

The foregoing disclosure and description of the invention are illustrative and explanatory thereof, and various changes in the size, shape and materials, as well as in the details of the illustrated construction, may be made without departing from the spirit of the invention.

What is claimed:

1. A downhole tool, comprising:

a. a body having a bore defining a minimum diameter therethrough;

said body defining a recess outside said bore;

b. a landing shoulder assembly movable between a retracted position where it is disposed within said recess and out of said bore, and a set position where it is set in said bore so that it can support an object passing into said bore said landing shoulder assembly being capable of sending a signal that it has reached its set position in response to a pressure sufficient to cause said landing shoulder assembly to move to its set position.

2. The tool of claim 1, wherein:

said body comprises a detent, said landing shoulder assembly engaging said detent to retain said retracted position of said landing shoulder assembly.

3. The tool of claim 2, wherein:

said landing shoulder assembly is biased toward said detent.

4. A downhole tool, comprising:

a. a body having a bore defining a minimum diameter therethrough, said body defining a recess outside said bore; and b. a landing shoulder assembly movable between a retracted position where it is disposed within said recess and out of said bore, and a set position where it is set in said bore so that it can support an object passing into said bore.

5. The tool of claim 4, wherein:

said extending segment and a portion of said base structure, after said break, are movable longitudinally with respect to said body.

6. The tool of claim 5, wherein:

said body further comprises a travel stop to limit said longitudinal movement, and a camming surface to push said landing shoulder of said extending segment into said bore.

7. The tool of claim 6, wherein:

said extending segment further comprises a plurality of collet fingers terminating in heads, each said head comprising a landing surface, each said surface defining a portion of said landing shoulder.

8. The tool of claim 7, wherein:

said body comprises a detent;

said fingers extending from said base structure in a manner that biases said heads into said detent to keep said landing surfaces on said heads within said recess.

9. The tool of claim 8, wherein:

said camming surface further comprises a portion of said detent so that said landing surfaces defining said landing shoulder are cammed out of said recess and into said bore when a portion of said base is broken and is displaced longitudinally with said fingers.

10. The tool of claim 9, wherein:

said body comprises a shoulder to engage an opposing shoulder on said heads to trap said heads against said travel stop, said bias on said fingers holding said shoulders opposite each other.

11. The tool of claim 6, further comprising:

said body formed to trap said extending segment adjacent said travel stop in a manner as to support said landing shoulder in said bore.

12. The tool of claim 11, wherein:

said extending segment comprises a plurality of fingers terminating in heads, each head having a landing surface which forms a portion of said landing shoulder;

said heads comprise a shoulder which engages and is retained by a shoulder on said body due to bias built into said fingers.

13. A subsea wellhead having a landing shoulder operable form the surface, comprising:

a. a body having a bore which defines the minimum diameter therethrough, said body further comprising a recess outside said bore;

b. a movably mounted landing shoulder assembly that in a retracted position is disposed in said recess to allow tubulars to pass that will clear through said bore and is a set position extends into said bore to support subsequently installed smaller tubulars, said movably mounted landing shoulder is positioned to be pressure actuated into said set position whereupon its movement into said set position results in a reduction of applied pressure to initiate said movement which in turn acts as a signal that said movement to said set position has occurred.

14. A subsea wellhead having a landing shoulder operable from the surface, comprising:

a. a body having a bore which defines the minimum diameter therethrough, said body further comprising a recess outside said bore;

b. a movably mounted landing shoulder assembly that in a retracted position is disposed in said recess to allow tubulars to pass that will clear through said bore and is a set position extends into said bore to support subsequently installed smaller tubulars;

said landing shoulder assembly selectively retained to said body and at least a first portion thereof configured to separate from a second portion, supported by said body, upon application of a predetermined force.

15. The wellhead of claim 14, wherein:

said body comprises a cam and a travel stop to guide said first portion of said landing shoulder assembly into said bore and to support it in said set position in said bore adjacent said travel stop.

16. The wellhead of claim 15, further comprising:

said body trapping said first portion of said landing shoulder assembly adjacent said travel stop.

17. The wellhead of claim 14, further comprising:

a setting tool insertable into said bore from the surface to apply said force to separate said first and second portions of said landing shoulder assembly;

said separating force required being of a sufficient magnitude to require energy input to said setting tool at a measurable level at the surface.

18. The wellhead of claim 17, wherein:

said setting tool comprises a hydraulic piston supporting at least one retractable dog, said dog, when extended, engages said first portion of said landing shoulder assembly whereupon movement of said piston separates said first and second portions of said landing shoulder assembly, giving a surface signal by virtue of a change in hydraulic pressure acting on said hydraulic piston.

19. The wellhead of claim 18, wherein:

said hydraulic piston is releasably retained by a retainer which adds to the required hydraulic pressure required to initiate movement of said piston.

20. The wellhead of claim 16, wherein:

said first portion of said landing shoulder assembly further comprises a plurality of collet fingers terminating in heads, each of which has a surface where said surfaces collectively define a landing shoulder;

said cam formed as a part of a groove in said body;

said fingers formed with a built-in bias to push said heads into said groove.

21. The wellhead of claim 20, wherein:

said heads are trapped adjacent said travel stop by engagement of a shoulder on said body with a shoulder on said heads with the assistance of said built-in bias.

22. The wellhead of claim 14, wherein:

said landing shoulder assembly comprises a pair of base rings circumferentially joined to each other in a connection designed to fail under a predetermined force;

one of said base rings travels longitudinally after it is severed from the other base ring which remains supported by said body;

said base ring, which travels longitudinally, supporting a landing shoulder which is cammed into said set position by said body as a result of said longitudinal movement.

23. The wellhead tool of claim 22, wherein:

said body comprises a travel stop and a lock shoulder;

said landing shoulder comprises a plurality of surfaces on collets that are formed with a bias toward said body, said bias holding said collets adjacent said travel stop with the aid of said lock shoulder.

24. A method of operating a subsea wellhead, comprising:

a. providing a body having a bore which defines the smallest diameter therethrough;

b. providing a movable landing shoulder initially in a recess so that it does not extend into said bore;

c. installing at least one tubular first string past said landing shoulder;

actuating said landing shoulder into said bore;

d. receiving a signal at the surface that said landing shoulder has been actuated into said bore; and e. supporting at least one second tubular string on said landing shoulder.

25. The method of claim 24, further comprising:

actuating said landing shoulder out of said recess with a setting tool.

26. A method of operating a subsea wellhead, comprising:

a. providing a body having a bore which defines the smallest diameter therethrough:

b. providing a movable landing shoulder initially in a recess so that it does not extend into said bore;

c. installing at least one tubular first string past said landing shoulder;

d. actuating said landing shoulder into said bore;

e. supporting at least one second tubular string on said landing shoulder;

f. actuating said landing shoulder out of said recess with a setting tool;

g. receiving a signal at the surface that said landing shoulder has been actuated;

h. engaging said setting tool to a portion of an assembly which includes said landing shoulder; and i. breaking off a portion of said assembly with said setting tool.

27. The method of claim 26, further comprising:

providing a pair of rings connected together at a weak connection as part of the support for said landing shoulder;

separating said rings with said setting tool.

28. The method of claim 27, further comprising:

providing a plurality of fingers, extending from one of said rings, each terminating in a head which has a surface such that the surfaces on the heads define said landing shoulder;

providing a groove in said recess;

disposing said heads in said groove to initially keep them clear of said bore.

29. The method of claim 8, further comprising:

using a built-in bias in said fingers to hold said heads in said groove;

forcing said heads out of said groove using the setting tool after one of said rings with said fingers is separated from the other ring.

30. The method of claim 29, further comprising:

moving said heads to a travel stop after pushing them out of said groove and into said bore;

trapping said heads adjacent said travel stop.

31. The method of claim 30, further comprising:

providing a shoulder on said body;

engaging a shoulder on said heads to said body;

using said built-in bias to secure said heads adjacent said travel stop by keeping said shoulders engaged.

* * * * *